US010737834B2

(12) United States Patent
Veldhuis et al.

(10) Patent No.: US 10,737,834 B2
(45) Date of Patent: Aug. 11, 2020

(54) COMPOSITE PALLET FOR THE TRANSPORT AND LONG-TERM STORAGE OF BARRELS

(71) Applicant: Cabka GmbH & Co. KG, Weira (DE)

(72) Inventors: Evert Veldhuis, Berlin (DE); Thorsten Lenz, Berlin (DE)

(73) Assignee: Cabka GmbH & Co. KG, Weira (DE)

( * ) Notice: Subject to any disclaimer, the term of this patent is extended or adjusted under 35 U.S.C. 154(b) by 0 days.

(21) Appl. No.: 16/308,390

(22) PCT Filed: May 22, 2017

(86) PCT No.: PCT/EP2017/062225

§ 371 (c)(1),
(2) Date: Dec. 7, 2018

(87) PCT Pub. No.: WO2017/211575

PCT Pub. Date: Dec. 14, 2017

(65) Prior Publication Data

US 2019/0177038 A1 Jun. 13, 2019

(30) Foreign Application Priority Data

Jun. 8, 2016 (EP) ..... 16173533

(51) Int. Cl.
*B65D 19/44* (2006.01)
*B65D 19/00* (2006.01)
(Continued)

(52) U.S. Cl.
CPC ..... *B65D 19/44* (2013.01); *B65D 19/0012* (2013.01); *B65D 19/0081* (2013.01);
(Continued)

(58) Field of Classification Search
CPC ..... B65D 19/44; B65D 19/385; B65D 2519/00034
(Continued)

(56) References Cited

U.S. PATENT DOCUMENTS 2,444,326 A * 6/1948 Baker ..... B65D 19/0026 108/55.3
3,993,168 A * 11/1976 Kubick ..... B65D 19/0034 108/53.1
(Continued)

FOREIGN PATENT DOCUMENTS

DE 35 04 314 A1 8/1986
EP 1 652 784 A1 5/2006
(Continued)

*Primary Examiner* — Jose V Chen

(57) ABSTRACT

A composite pallet for the transport and long-term storage of barrels, comprising a base element made of plastic with a top side, an under side and support projections; a deck element made of plastic with a top side for storing the barrels; and a depositing area for holding a vertical barrel. The deck element has an under side and support projections resting on the base element support projections, and is supported against the base element; the deck element under side is at a distance from the base element top side. Support inserts made of a material with a creep modulus which is higher over a predefined period than a creep modulus of plastic, and the decrease in which is lower than that of plastic over the specified period, are locked into holders on the deck element under side and on the base element top side.

19 Claims, 14 Drawing Sheets

(51) Int. Cl.
*B65D 19/38* (2006.01)
*B65D 85/62* (2006.01)

(52) U.S. Cl.
CPC ..... *B65D 19/385* (2013.01); *B65D 85/62* (2013.01); *B65D 2519/00034* (2013.01); *B65D 2519/00069* (2013.01); *B65D 2519/00094* (2013.01); *B65D 2519/0094* (2013.01); *B65D 2519/00099* (2013.01); *B65D 2519/00109* (2013.01); *B65D 2519/00129* (2013.01); *B65D 2519/00134* (2013.01); *B65D 2519/00273* (2013.01); *B65D 2519/00288* (2013.01); *B65D 2519/00318* (2013.01); *B65D 2519/00343* (2013.01); *B65D 2519/00373* (2013.01); *B65D 2519/00412* (2013.01); *B65D 2519/00567* (2013.01); *B65D 2519/00815* (2013.01)

(58) Field of Classification Search
USPC ..... 108/57.25, 57.26, 55.3, 55.5
See application file for complete search history.

(56) References Cited

U.S. PATENT DOCUMENTS 4,013,256 A * 3/1977 Hill ..... B65D 19/44 248/346.02
5,662,048 A * 9/1997 Kralj ..... B65D 19/0012 108/56.1
5,676,063 A * 10/1997 Wallace ..... B65D 19/0093 108/55.3
5,769,376 A * 6/1998 Bostic ..... B65D 81/261 108/55.1
5,857,416 A * 1/1999 Donnell, Jr. ..... B65D 19/004 108/55.3
5,918,551 A * 7/1999 Liu ..... B65D 19/10 108/53.1
5,937,767 A * 8/1999 Togawa ..... B65D 19/0012 108/57.26
5,970,885 A * 10/1999 Polando ..... B65D 19/44 108/55.3
6,112,672 A * 9/2000 Heil ..... B65D 19/0026 108/54.1
6,360,676 B1 * 3/2002 Schepers ..... B65D 19/0095 108/52.1
6,484,877 B1 * 11/2002 Murakami ..... B65D 19/44 108/55.3
6,550,741 B1 * 4/2003 Cottone ..... B60P 7/12 108/51.11
6,558,093 B1 * 5/2003 Arnold ..... B65D 19/0077 108/55.3
7,555,879 B1 * 7/2009 Utz ..... B65D 19/0095 108/56.3
2011/0259249 A1 * 10/2011 Ogburn ..... B65D 19/0038 108/57.33
2013/0180437 A1 * 7/2013 Wilcox ..... B65D 7/24 108/56.3
2014/0000494 A1 * 1/2014 Gysin ..... B65D 19/0095 108/56.3
2016/0251114 A1 * 9/2016 Lee ..... B65D 19/44 108/55.3
2019/0300235 A1 * 10/2019 Jefferson ..... B60B 33/0086

FOREIGN PATENT DOCUMENTS

EP 2 722 285 A1 4/2014
GB 1 356 736 A 6/1974
NL 7207188 A 7/1973
WO WO 2012/010138 A1 1/2012
WO WO 2016/033414 A1 3/2016

* cited by examiner a)

b)

c)

COMPOSITE PALLET FOR THE TRANSPORT AND LONG-TERM STORAGE OF BARRELS

PRIORITY CLAIM

This application is a National Phase of PCT Patent Application No. PCT/EP2017/062225 having International Filing Date of May 22, 2017, which claims the benefit of priority of European Patent Application No. 16173533.7 filed on Jun. 8, 2016, now European Patent No. 3254983, the disclosures of which are hereby incorporated by reference herein in their entirety.

FIELD OF THE INVENTION

The invention relates to a composite pallet for the transport and long-term storage of barrels.

BACKGROUND OF THE INVENTION

Composite pallets, i.e. pallets which consist of different materials, have already been known in the state of the art for a long time. Thus a plurality of plastic pallets with metal inserts, such as are described for example in European patent no. 2 722 285, is offered. The metal inserts here ensure an additional reinforcement of the base and increase the resistance to mechanical loads on the base side.

In German patent application 35 04 314, a composite pallet made of wood or plastic with metal is described, with inner parts made of wood or plastic, which are formed as load-transmitting elements, and metal frames, which surround the support strips of a lower deck and an upper deck.

In some fields of industry, pallets are required which must be designed for the storage of containers over a very long period, in particular in terms of the storage of solid or liquid substances in barrels. Thus, for example, in the field of whisky production, selected whiskies are stored in wooden barrels over a period of 12 to 18 years. In many other branches, the long-term storage of barrels or containers in general also plays an important part. For this, wooden barrels are typically placed on pallets, several pallets with barrels are stacked one on top of another, wherein the under sides of each of the upper pallets lie on the barrels.

By a barrel is meant here, as a rule, a cylindric or cylindrical container produced from wood, metal or plastic, which can also be formed with a bulge. Barrels without a bulge are also called drums. Such a barrel usually serves to store liquids and as a rule is then filled via a bunghole, but it can also serve to store solid or powdered substances and is then, as a rule, provided with a lid. The shape of conventional barrels serves primarily to simplify transport by rolling, with the result that if the barrels are not rolled but transported by machines for example, other container shapes also fulfil the function of a barrel, for example cuboid containers, which in this sense can also be called barrels.

Wooden pallets, which have the necessary long-term stability if the wood is defect-free, are usually used for storing barrels.

However, the use of wooden pallets has disadvantages. For example, over time, wooden pallets acquire black marks if wooden barrels with spirits are stored on them. These marks result from the gas release of alcohol from wooden barrels. In addition, it is possible that the wood will warp over the years because as a rule, long-seasoned, expensive wood is not used in pallet production. This can lead to instabilities in the storage in particular of pallets with barrels stacked one on top of another. Finally, the use of plastic pallets allows a greater flexibility, which can be provided for example via different inserts for the shapes to be used for production. In principle, the durability of plastic pallets, unless they are subjected to continuous loading at isolated points, is also greater than that of wooden pallets.

However, when considering long-term stability, it is to be borne in mind that the barrels—in particular those with a stepped rim at the top and bottom—subject the pallet on which they are stored to a continuous, if spatially narrowly limited, loading. If plastic is used as a material for the pallets, such a constant long-term loading always at the same place results in a creep, in a retardation, which can greatly impair the stability of the whole pallet and the stableness of the barrels stored thereon, for which reason plastic, despite its advantageous properties, has not yet been used for pallets which are provided for the long-term storage of barrels—i.e., over a period of at least 12 years.

SUMMARY OF THE INVENTION

An object of the invention is therefore to construct a pallet made substantially of plastic which is suitable for the long-term storage of barrels.

This object is achieved by a composite pallet, i.e., a pallet made of two different materials. One of the materials is plastic. The composite pallet firstly comprises a base element and a deck element, each made of plastic. The base element has a base element top side, a base element under side and base element support projections formed projecting from the base element top side. The deck element correspondingly has a deck element top side, a deck element under side and deck element support projections formed projecting from the deck element under side.

A deck for storing the barrels is formed on the deck element top side. The deck element is supported against the base element in that the deck element support projections lie on the base element support projections or are connected thereto. The connection can be produced for example by a snap lock. However, it can also be produced by friction locking and/or positive locking, for example by screws or formation of a plug and socket connection using static friction. A substance-locking connection is also possible, for example by adhesion or also through one-piece manufacture.

In addition, on the deck element top side the composite pallet has at least one depositing area for holding a vertical barrel, which in the simplest case is a flat surface. However, the composite pallet comprises in particular several support inserts, which are inserted into support element holders formed on the deck element under side and on the base element top side. The support inserts inserted into the support element holders are connected to the support element holders by friction locking and/or positive locking. For example, they can be held by static friction in the support element holders, into which they can be inserted in the case of a composite pallet consisting of several parts. In the case of a one-piece manufacture, the support inserts are inserted into the mold for example before production and partially overmolded with liquid plastic there, with the result that the support inserts are connected to the support element holders by positive locking. The support inserts are arranged in support areas, which are at least partially located underneath the at least one depositing area.

The particular thing about support inserts is that they are manufactured from a material which has a creep modulus which is higher than that of plastic over a predefined period—as a rule at least the expected or desired life of the pallet, for example twelve years. The creep modulus $E_c(t)=\sigma/\varepsilon_{tot}(t)$ is a measure of the creep of materials, wherein $\sigma$ denotes the mechanical stress and $\varepsilon$ the time-dependent strain. The creep modulus for plastic tends to be low, i.e., here the strain is relatively great and increases further over time. This applies correspondingly to a compression.

While plastic, in the case of continuous loading at isolated points, loses its stability through creep at these points, and a creep is to be expected in the depositing areas, in particular at their rims, the lack of long-term stability can be offset and compensated for by such support inserts, which then lie completely or partially underneath the at least one depositing area. Suitable materials with a correspondingly high creep modulus are for example stone, stainless steel, wood or concrete. The support areas are each arranged or positioned relative to a depositing area such that they ensure the stable storage of a barrel deposited in the depositing area, even if a plastic layer located for example between support insert and base of the barrel has already mostly disintegrated or its stability has been impaired as a result of creep. In other words, stable storage is realized not by the depositing area on the deck element top side, but solely by the support inserts in correspondingly arranged support areas.

In the case of a flat deck element top side, the depositing areas can be simple color-highlighted, for example circular marks which indicate where a barrel is to be deposited on the composite pallet. Circles of different sizes make possible an adaptation to barrel-base diameters of different sizes, i.e. different barrel sizes. The support inserts and support areas are then dimensioned such that they cover all possible barrel-base diameters, i.e., stable storage over the predefined period is possible for each diameter which is marked on the depositing area. In a preferred design, however, the at least one depositing area is formed as an indentation with a rim edge for holding a vertical barrel, preferably in a positive-locking manner. This makes possible a secure positioning on the composite pallet and also secures the barrels against unintentional displacement during transportation of the composite pallet or when further barrels are deposited on the pallet.

The composite pallet has at least one depositing area, as a rule however it is designed to carry several barrels, for example four, six or eight barrels. For typical whisky barrels, for example, old sherry barrels, a number of depositing areas of six has proved practicable in terms of capacity and handling. The breadth and length of the composite pallets can then be designed exactly as large as the currently used wooden pallets, and gradually replace them. In order to adapt an indented depositing area to different diameters of barrel bases, it is possible for example to use ring-shaped inserts, however as a rule different composite pallets are then provided for different barrel base diameters.

The support inserts can be shaped in different ways, in the simplest case they are designed, for example, cuboid or cylindrical and have a support insert top side which is preferably designed flat. Located in the region of the support area in the deck element top side there is then a recess or opening in which there is no plastic, and the support insert top side then lies in a plane with the deck element top side. This can be realized both for the case in which the depositing area is flat and for the case in which the depositing area is indented, in the latter case the support insert top side lies in a plane with the deck element top side in the region of the at least one depositing area. In this embodiment with recesses, there is thus no plastic layer of the deck element between the support insert and the base of the barrel, the barrel is stored directly on the support inserts, with the result that a long-term stable storage is guaranteed, regardless of the behavior of the plastic, and a creep of the plastic is also greatly reduced, which makes it possible to reuse the pallet. In an indented depositing area, the proportion of the heights can also be formed such that the support insert top side is below the height of the rim edge of the depositing area, but above the flat area of the depositing area. Storage then takes place exclusively on the support inserts and the barrel is also sufficiently secured against a lateral displacement.

The support inserts can be arranged directly underneath the at least one depositing area and support the barrel centrally. In a preferred design, however, at least one first partial quantity of the support inserts is arranged underneath the rim—which also has a rim edge in the case of an indentation—of the at least one depositing area. Thus support areas can be arranged both completely underneath the at least one depositing area and underneath the rim, i.e., only partially underneath the depositing area. All support areas or support inserts can also be arranged underneath the rim of the at least one depositing area, if sufficient support areas are provided which guarantee the stability of the vertical barrel. For stable storage, at least three support areas or support inserts per depositing area are required underneath the rim of this depositing area if the support inserts are constructed cuboid or cylindrical and intended to absorb loads only at isolated points. If more support areas with support inserts are to be used, the storage becomes more stable, but on the other hand the composite pallet absorbs more weight, which makes it more difficult to handle and is disadvantageous in particular also when several pallets with barrels are stacked in between, as the load on the barrels is increased. In principle, ring-shaped support inserts which emulate the barrel base can also be used, the indentation with rim edge can be formed on these rings. A very good compromise, which relates to the stability of the storage on the one hand and the weight of the composite pallet on the other, is obtained when four support areas are provided per depositing area. The support areas with the support inserts can be square, for example, with the support inserts arranged in the corners of the square. If the depositing area is formed as an indentation, for the lateral stabilization of the barrel to be deposited there it is advantageous, but not imperative, if the rim edge, i.e., the contour of the rim of the indentation, is emulated on the support insert top sides of several support inserts of this first partial quantity.

Expediently, the support element holders for the support inserts are incorporated into the deck element support projections and the base element support projections. In this way, no separate projections or holders are required, thus the material consumption is less.

Whereas as a rule the barrels are stored vertically in the depositing areas on the pallets, it can be desirable under certain circumstances to also store barrels horizontally on such a pallet, if for example the height of the spaces in which the pallets are stacked allows only a horizontal, not a vertical, storage of the top-most layer. In a preferred design of the invention, the composite pallet therefore also comprises several bearing elements with a bearing element top side and a bearing element under side as well as means for the friction-locking and/or positive-locking connection of the bearing elements on the bearing element under side to the deck element on its deck element top side, preferably in the depositing areas, at positions provided for this. The means for friction-locking and/or positive-locking connection are preferably formed as snap locks, which makes possible a simple insertion and removal. Corresponding openings are provided in the depositing areas to hold the snap locks. However, the bearing elements can also be screwed, plugged in or connected in another way to the deck element. A simple placement in the depositing area, without producing a fixed connection, is also possible.

The bearing element top side of each bearing element is provided with a first concavely cambered surface with a first concave curve for storing a horizontal barrel. The bearing element can be formed such that it fills for example the whole indented depositing area, but it can also be formed such that it fills only a part of the depositing area, with the result that several, for example two, bearing elements can be arranged in one depositing area. A barrel is then held for example by two bearing elements in the top and bottom rim area of the barrel, wherein the two bearing elements are arranged in different depositing areas. The stability of the horizontal barrels is greater in this case than in the case of the central storage of a barrel on only one correspondingly dimensioned bearing element.

To store barrels with a bulge, it is advantageous if the first concavely cambered surface of each bearing element has a second concave curve perpendicular to the first concave curve. Through this second curve, the stability during storage is further increased. To store a barrel, for example two bearing elements can be arranged mirror-symmetrical to each other in two depositing areas each, wherein the two second concave curves of the two bearing elements form a combined concave camber, corresponding to the bulge curve of the barrel. Different bearing elements with different first and second curves can be provided, with the result that an adaptation to different barrel sizes is possible with flexibility. However, bearing elements which have a central curve for the first and for the second concave curve in each case, formed across all barrel types provided for use, can also be used.

In a further preferred design, the bearing element top side of each bearing element is provided with a second concavely cambered surface which has a combined curved edge with the first concavely cambered surface, wherein the normal vectors on both sides of the combined edge perpendicular thereto enclose a non-zero angle. This makes it possible to store the barrels in an even more flexible manner, as the bearing element can hold a barrel from both sides. In addition, the depositing areas can be utilized better as the bearing elements can then also be arranged one behind another without mirror symmetry. The second concavely curved surface can be formed analogously to the first, and can have the same curve or the same curves in two directions perpendicular to each other.

However, in the simplest design, the surface for supporting the barrels, in the case of a bearing element, is simply designed as a segment of a hollow cylinder both in terms of the length and in terms of the section or the segment of the circle determining the cylinder cross section. Such a bearing element is advantageous, for example, for drum-shaped barrels without a bulge.

The composite pallet advantageously comprises further support inserts, and formed on the under side of each bearing element there are bearing support element holders to hold these further support inserts. This increases the stability of the pallet in the storage of horizontal barrels. When bearing elements are used, the bearing support element holders are particularly advantageously arranged above support element holders of the deck element top side. Then the loading resulting from horizontal barrels is transferred via the further support inserts onto the support inserts inserted into the deck element, with the result that the creep of any plastic layer located between the support inserts and the further support inserts is then immaterial. Particularly advantageously, the further support inserts therefore have support insert under sides which rest against support insert top sides of the support inserts inserted into the deck element, i.e., a direct contact of the support inserts and the further support inserts is realized while avoiding an intermediate plastic layer. In this way, the greatest long-term stability is also guaranteed here. The further support inserts, like the support inserts, are preferably made of concrete, wood, stainless steel or stone, and satisfy the same conditions in terms of creep modulus as the support inserts.

Usually, several pallets with barrels are stacked one on top of another. The upper pallets are stored on the barrels standing below them, whereby the latter are likewise exposed to continuous loads, also because they themselves transmit the load. If in addition the barrels have slightly different heights, taller barrels are loaded more heavily than shorter barrels. In the case of wooden barrels, this can have the result that the staves, usually held together by barrel hoops, bulge further outwards, with the result that gaps which are large enough for liquid or gas to leak out form between the individual staves. The losses can amount to several percent annually and are thus significant from a financial point of view.

The load on the barrels resulting from the pallets arranged above them can be reduced and even avoided by a particularly preferred design of the invention. In this particularly preferred design, the composite pallet also comprises several supporting rods for connection to a further composite pallet and for support against same. The supporting rods are likewise formed from a material with a higher creep modulus than that of plastic, preferably from wood or stainless steel, which is corrosion-resistant in an atmosphere of higher humidity, such as prevails in the storage rooms, for example, with barrels with distillates. The deck element and the base element have several through-openings for clasping the circumference of the supporting rods inserted into the through-openings by positive locking.

Each supporting rod has two ends, in one design the ends of the supporting rods used are in direct contact with support inserts. As a result, the loading of the deck element and that of the base element of the composite pallet with the weight of the further composite pallet are reduced. The supporting rods inserted, for example, into a deck element are in direct contact there with the support inserts arranged underneath the openings, i.e., they lie for example on the flat support insert surfaces. At their other end they are inserted into the further composite pallet and there rest against corresponding support insert under sides of support inserts, which are held there in a support element holder on the base element under side. In principle, however, the height of the support inserts is such that they must be held both by the support element holders on the base element under side and by the support element holders on the deck element top side. By means of the supporting rods, in this way the loading caused by the weight of the barrels is directed further downwards solely via the support inserts and the supporting rods, the loading of the barrels resulting from a composite pallet stacked on top can be reduced in this way, and thus also the loss of liquid. The support inserts of the bottom pallet preferably lie with an under side on the ground when the pallet is stored on the ground.

In order to further reduce the loading of the barrels, and in particular also to be able to compensate for different heights of the barrels, in another design height-adjustment elements are connected to the ends of the supporting rods. In a simple design, the supporting rods are cylindrical in shape and have an internal screw thread, thus are at least partially hollow. The height-adjustment elements then have a matching external screw thread, with the result that the height can be adjusted by turning the supporting rod screwed onto the height-adjustment element. It is sufficient in principle if in each case one end of the supporting rods is provided with a height-adjustment element, but it is also possible—in particular for better handling—for both ends of the supporting rods to be provided with a height-adjustment element. The loss of liquid through leaking out of gaps can be minimized with this mechanism.

In the simplest case, the height-adjustment elements are continuations of the supporting rods and, instead of the ends of the supporting rods, these are then in direct contact with the support inserts. Instead of such simple, cost-effective and, as far as possible, maintenance-free height-adjustment elements, hydraulically or pneumatically operated height-adjustment elements can also be used. An important aspect is that the effective length of the supporting rods can be altered in this way, the spacing between two composite pallets can thus be varied by adjusting the height.

Separate support inserts can be provided to support the supporting rods. However it is also possible to form support inserts of a second partial quantity of the support inserts as preferably one-piece combination support inserts, wherein in the case of a combination support insert every two support inserts are connected together by a bar running parallel to the deck element top side. The two support inserts which are connected each lie underneath different depositing areas or their rim areas. It is thereby possible for the bars of the combination support inserts to be placed underneath the openings for holding the supporting rods, and the supporting rods and/or the height-adjustment elements can rest against a bar. This reduces the outlay on individual parts and allows production to be more cost-effective.

There are also different possibilities for producing a deck element and a base element. It has already been discussed at the outset that the composite pallet or its plastic component can be manufactured in one piece, wherein the support inserts are then introduced into the mold before injection, or inserted into it thereafter, wherein they are secured against displacement in the vertical direction by friction locking.

Another possibility is to manufacture deck and base elements individually, namely with a shape which guarantees their nestability. This simplifies the storage of composite pallets not in use. In particular, deck and base element can also be constructed identical, in the composite pallet they are then arranged mirror-symmetrical relative to a mirror plane, wherein the mirror plane lies parallel to the deck element top side and to the base element under side and is at the same distance to both. Formed on the base element under side there are then areas corresponding to the depositing areas, which can stabilize the barrels on their top rims if the depositing areas are indented.

In a particularly preferred design, the composite pallet is delivered as a kit, i.e., the support inserts, bearing elements and further support inserts, supporting rods, and deck and base elements are delivered as separate parts and fitted together by staff on site, which saves on costs during production.

It is understood that the features named above and those yet to be explained in the following are applicable not only in the stated combinations but also in other combinations or alone, without departing from the scope of the present invention.

BRIEF DESCRIPTION OF THE DRAWINGS

The invention is explained in even more detail below by way of example with reference to the attached drawings, which also disclose features essential to the invention. There are shown in.

DETAILED DESCRIPTION

Figure 1:
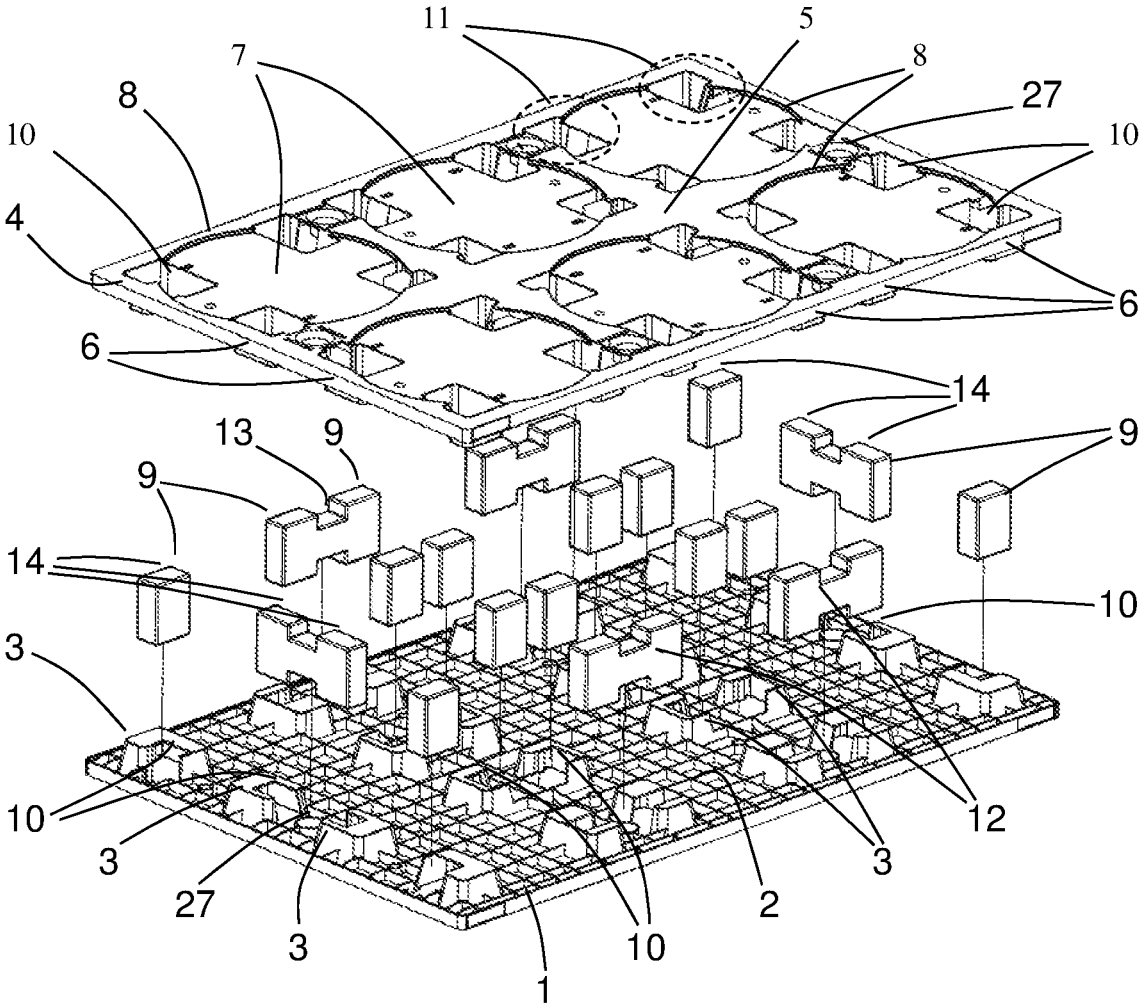
FIG. 1 an exploded drawing of a first design of a composite pallet.

FIG. 1 shows an exploded representation of a first design of a composite pallet for the transport and long-term storage of barrels. The composite pallet comprises a base element 1 made of plastic with a base element top side 2, a base element under side, not shown, and base element support projections 3 which are formed projecting from the base element top side 2. The base element 1 is formed board-like and has a stabilizing, material-saving lattice structure on its base element top side 2. The base element under side lies parallel to the base element top side, it can be created smooth, but the lattice structure formed on the top side can also continue into the base element under side, with the result that the base element 1 has a continuous lattice structure.

The composite pallet also comprises a deck element 4 made of plastic with a deck element top side 5 on which a deck for storing the barrels is formed. The deck element 4 further comprises a deck element under side, not shown, and deck element support projections 6 formed projecting from the deck element under side. The composite pallet also comprises at least one depositing area 7 for holding a vertical barrel. This is located on the deck on the deck element top side 5. In the simplest case, the depositing area 7 consists of a simple mark on an otherwise smooth surface. Depending on the size of the composite pallet, one depositing area 7 or several depositing areas 7 can be defined on the deck. In the present case there are six depositing areas 7. This is a particularly advantageous quantity for handling the composite pallet with a forklift in terms of space requirement, weight and handling. In addition, in the case of the composite pallet shown the depositing areas 7 are formed not as flat marks or areas, but as indentations with a rim edge 8 for preferably positive-locking holding of a vertical barrel or the base of a barrel. On the one hand, the people loading the pallets are thereby shown the positions at which the barrels are to be deposited. On the other hand, the depositing areas 7 formed as indentations also secure the deposited barrels to a certain extent—depending on the force exerted—against lateral displacement out of these ideal positions. As a rule, an incorrect positioning results in a tilting of the barrel, which is recognizable by eye and can be corrected immediately by staff.

Such indentations or depositing areas 7 can also be formed on the base element under side, with the result that the barrels in the case of pallets stacked one on top of another are secured against lateral displacement both on their bottom rim and on their top rim. In particular it is possible to construct deck element and base element identical. This reduces production costs as only one tool is required for the base element 1 and the deck element 4. In the case of an identical construction, deck element 4 and base element 1 are arranged in the composite pallet mirror-symmetrical relative to a mirror plane which lies parallel to the deck element top side 5 and to the base element under side and is at the same distance to both, thus intersects the composite pallet centrally with respect to its height.

It is guaranteed by the base element support projections 3, which rise from the base element top side 2 or project therefrom, and by the correspondingly formed deck element support projections 6 that the deck element 4 is supported against the base element 1 and the deck element under side is at a distance from the base element top side 2.

The deck element 4 and the base element 1 are both made of plastic. This is formed from large molecular chains, which are also entangled in some forms of plastics. Under external loading, these slip or disentangle, which leads to strain. Application of force to plastic over a longer period results in a progressive deformation, creep, which is also called retardation. This is a plastic, irreversible deformation. Pallets made of plastic therefore cannot cope with the long-term storage of barrels over a period of at least twelve years without further measures, as the loads which are exerted via the barrel base or even just the rims of the barrels on the plastic or the depositing areas are so high that a plastic deformation occurs in every case. This applies to a particular degree when several pallets are stacked one on top of another. Stability cannot be guaranteed over such a long period as the plastic creeps or retards too much.

The so-called creep modulus $E_c(t)=\sigma/\varepsilon_{tot}(t)$ is a measure of the creep in the case of plastic, wherein $\sigma$ denotes the mechanical stress and $\varepsilon$ the time-dependent strain. The creep modulus for plastic tends to be low, i.e., here the strain is relatively great. However, there are enough materials, such as for example steel, wood, stone or concrete, in which the tendency to creep, i.e., the time-dependent strain or compression—corresponding to a strain with the opposite sign—is lower than in the case of plastic. Therefore, in order to make the composite pallet shown in FIG. 1 suitable for long-term storage, the composite pallet comprises several support inserts 9 made of a material with a creep modulus which is higher over a predefined period than the creep modulus of plastic, and the decrease in which is less than that of plastic over the predefined period. Advantageously, the creep modulus is almost constant over the predefined period. The predefined period corresponds to the minimum period for which the barrels must be stored, for example eight, twelve or 18 years.

The support inserts 9 are inserted into support element holders 10 which are formed on the deck element under side and on the base element top side 2. When they are inserted, the support inserts 9 are connected to the support element holders 10 by friction locking and/or positive locking. A positive-locking connection can be effected for example when the composite pallet is manufactured in one piece and the support inserts 9 are at least partially surrounded by the support element holders 10 and/or the material of the base element 1 and the deck element 4. However, there is also the possibility, as is realized in particular in the case of the two-part pallet, of arranging the support inserts in friction-locking manner in the support element holders 10, for example by wedging them into the support element holders 10, wherein areas of the base element top side 2 or of the deck element under side counted among the support element holders can also be used to produce the friction locking. The edges of the support element holders 10 can be formed slightly smaller relative to the dimensions of the support inserts 9.

In order to be able to absorb the loading exerted by the barrels and the pallets lying above them, the support inserts 9 are arranged with their support element holders 10 in support areas which lie at least partially underneath the at least one depositing area 7. These areas are shown in the deck element top side 5 in FIG. 1 as dashed circled openings 11, there are four such support areas for each depositing area 7.

Substances with a corresponding high creep modulus, which display no or only slight strain or compression over the predefined period, for example wood, stone, steel, in particular stainless steel, or concrete, come into consideration as material for the support inserts. In addition to wood, concrete in particular has the advantage that a plurality of possible types are available here, of which some in particular have a low specific weight with nevertheless high stability, which facilitates handling. As the specific weight of the support inserts 9 is higher than that of plastic, the support inserts should be constructed no larger than necessary in order to guarantee the required stability on the one hand and not to allow the pallet to become too heavy on the other hand.

At least one first partial quantity of the support areas is arranged underneath the rim of the at least one depositing area 7. The first partial quantity can also comprise all support inserts 9, as is the case with the composite pallet shown in FIG. 1. However, it is also possible to position further support inserts 9 for example centrally underneath the depositing areas 7 for additional support.

In the case of the composite pallet shown in FIG. 1, some support inserts 9 of a second partial quantity of the support inserts 9 are formed as preferably one-piece combination support inserts 12, in each combination support insert 12 the two support inserts 9 are connected by a bar 13 running parallel to the deck element top side 5. The function of the bar 13 is explained further below.

Figure 4:
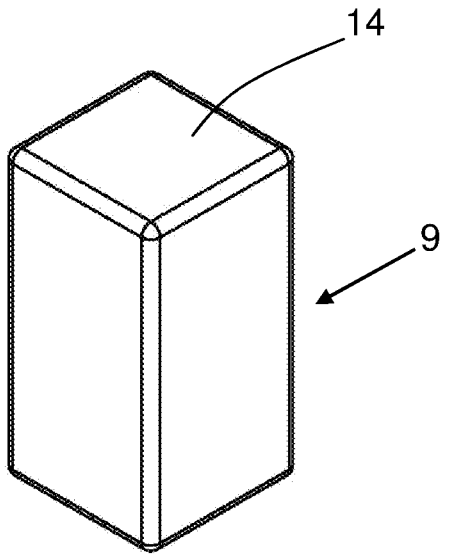
Figure 5:
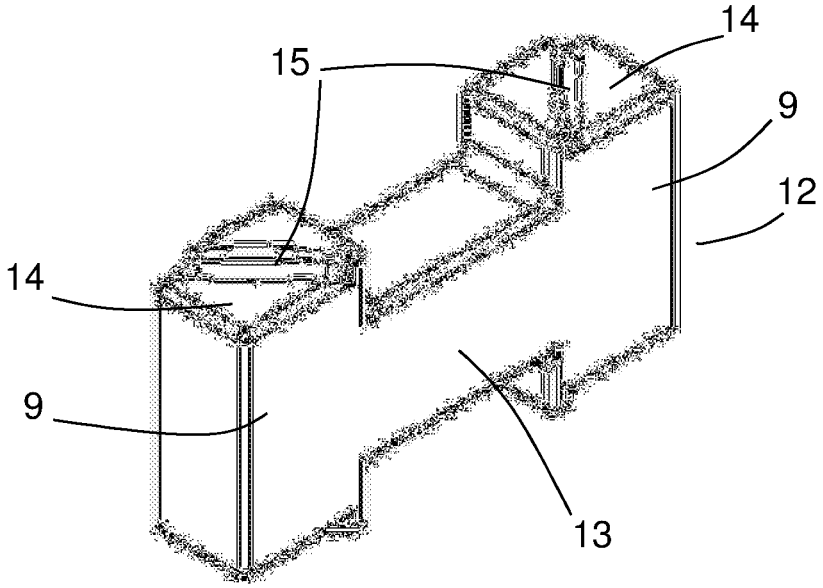

A typical design of a support insert 9 and a design of a combination support insert 12 are represented in FIGS. 4 and 5 respectively. Each support insert has a support insert top side 14. In the region of each support area in the deck element top side 5, there is a recess which corresponds to the dashed circled openings 11 in FIG. 1. The support insert top side 14 of each support insert 9 lies in a plane with the depositing area 7 on the deck element top side 5. In principle a positioning underneath the plane of the depositing area 7 is also possible if the plastic pallet has no recesses or openings 11. However, the positioning as shown in FIG. 1 has the advantage that the rims of the barrels can be stored directly on the support insert top sides 14, thus between barrel and support insert 9 there is no plastic layer the creep of which could impair the stability of the composite pallet loaded with barrels. In this case, the creep of the plastic can be eliminated as far as possible in this area. The under side of the support inserts 9 are also advantageously dimensioned or inserted into the base element 1 such that their under side lies in a plane with the base element under side, the load is thus borne substantially by the support inserts 9, which are then in contact with the ground for example.

If the depositing area 7 is designed as an indentation with a rim edge 8 and not just with a mark as a rim on the deck element top side 5, the support insert top sides 14 can be formed flat and lie in a plane between the plane of the depositing area 7 and the plane predefined by the height of the rim edge 8, including these planes. However, optionally the rim edge 8 of the indentation can be emulated as a contour 15 on the support insert top sides 14 of several support inserts 9 of the first partial quantity. This is the case for example in the combination support insert 12 shown in FIG. 5. Such an embodiment has the advantage that the barrel is better protected against lateral displacement. A particular advantage arises, however, if the composite pallet is constructed symmetrical, i.e., with a deck element 4 identical to the base element 1 and a mirror symmetry relative to a plane central between deck element under side and base element top side 2, which implies that the support elements 9 as well as the combination support inserts 12 are also constructed symmetrical: the support inserts 9 of the first partial quantity can then serve both for clasping the barrel rims on the top side and for support against the ground—with the surface shown raised in FIG. 5 outside the region which lies in the depositing area 7, thus the raised part of the support insert surface 14. Suppplementarily or alternatively, the support insert surfaces 14 of the individual support inserts 9 which are not combined to form combination support inserts 12 can also optionally be formed with corresponding contours 15.

As shown in FIG. 1, the support element holders 10 for the support inserts 9 are incorporated into the deck element support projections 6 and the base element support projections 3. This is not strictly necessary, the support element holders 10 can also be realized independently of the support projections, but the construction shown is simple and material-saving.

Figure 2A:
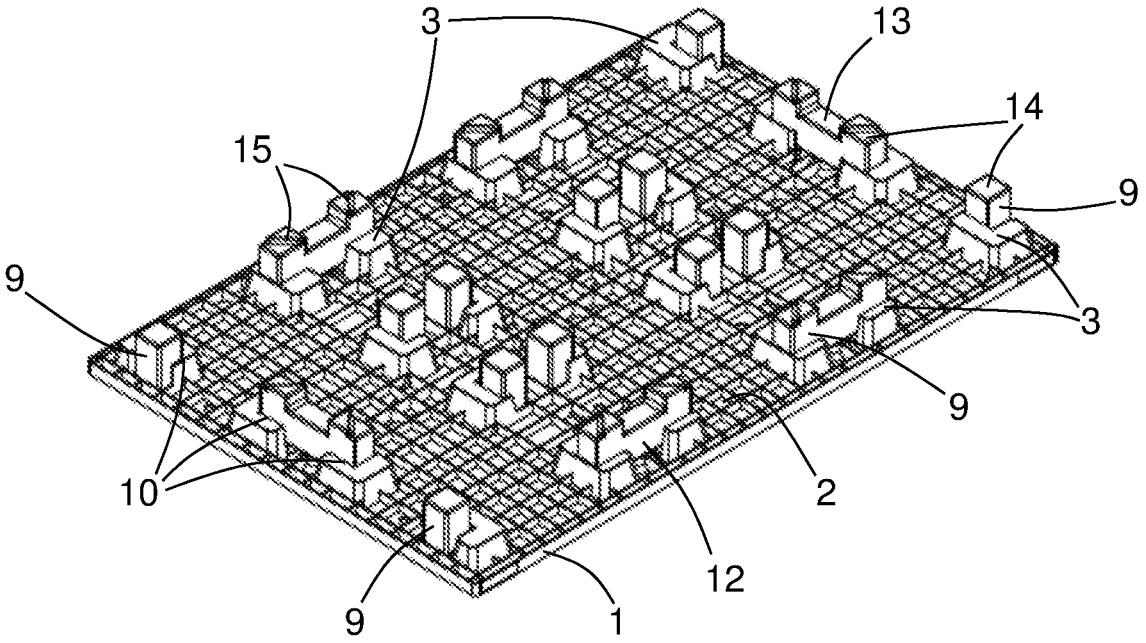
FIG. 2*a* the base element of a composite pallet with inserted support inserts, FIG. 2*b* a perspective view of an assembled composite pallet, FIG. 2*c* a side view of a composite pallet, FIGS. 3*a, b* two further designs of a composite pallet, FIG. 4 a support insert, FIG. 5 a combination support insert, FIGS. 6*a*)-*c*) different views of a bearing element, FIG. 7 a composite pallet with bearing elements inserted therein, FIG. 8 a composite pallet with inserted supporting rods, FIG. 9 a height-adjustment for a supporting rod, FIG. 10 the load transmission in the area of the supporting rods, FIG. 11 the load transmission over several pallets, FIG. 12 nested stacked deck elements FIG. 13 two composite pallets, connected via supporting rods, with barrels stored thereon, and FIG. 14 an exploded drawing of the system from FIG. 13.

Whereas FIG. 1 shows an exploded drawing of a composite pallet, in FIG. 2*a* a base element 1 of such a pallet is represented, in which the support inserts 9 including the combination support inserts 12 are inserted into the support element holders 10. Deviating from FIG. 1, contours 15 are formed as a continuation of the rim edge 8 of the depositing area 7 formed indented in the case of those support inserts 9 which are part of the combination support inserts 12. However, this is not imperative, such contours 15 can also be formed on individual support inserts 9, for example in the corners of the base element 1.

Figure 2B:
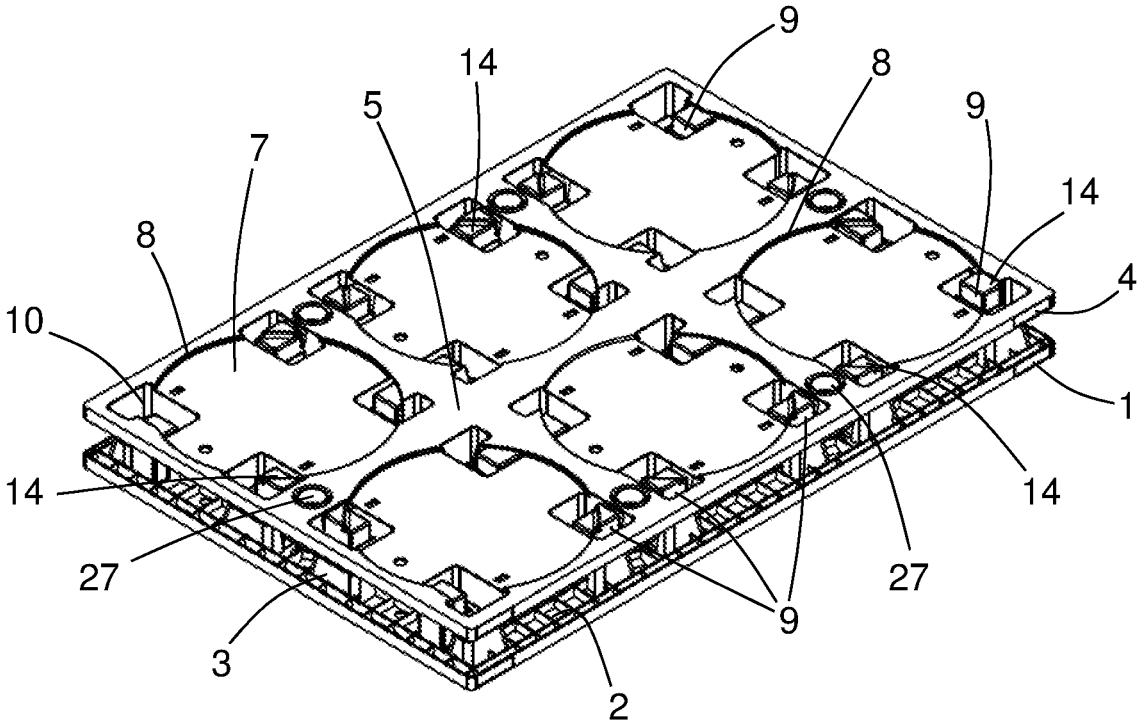
Figure 2C:
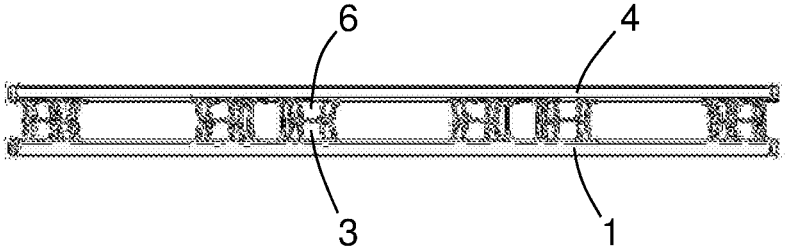

Finally, FIG. 2*b* shows a perspective view of the assembled composite pallet, and FIG. 2*c* the composite pallet from the side. The deck element support projections 6 lie on the base element support projections 3 and/or are connected thereto. This can be seen in FIG. 2*c*. The deck element 4 can also be manufactured in one piece with the base element 1, the connection between deck element support projections 6 and base element support projections 3 is then substance-locking as the same material is involved. However, the connection can also be produced in a different way, for example, likewise in substance-locking manner by adhesion, in positive-locking manner by screwing or in friction-locking manner by plugging one into the other corresponding to a plug and socket connection, wherein combinations are also possible. In the case of a design not in one piece, a connection between deck element 4 and base element 1 can also or additionally be produced by a friction-locking connection of the support inserts to deck element 4 and base element 1, wherein the latter simply just lie one on top of another.

Figure 3A:
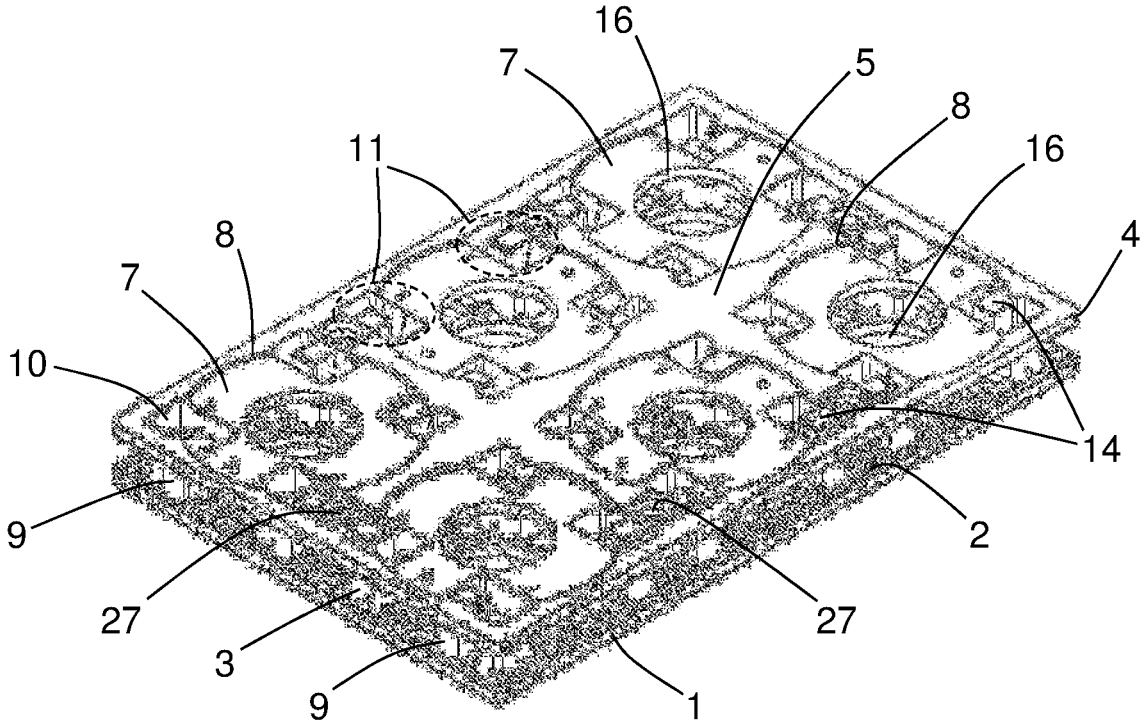
Figure 3B:
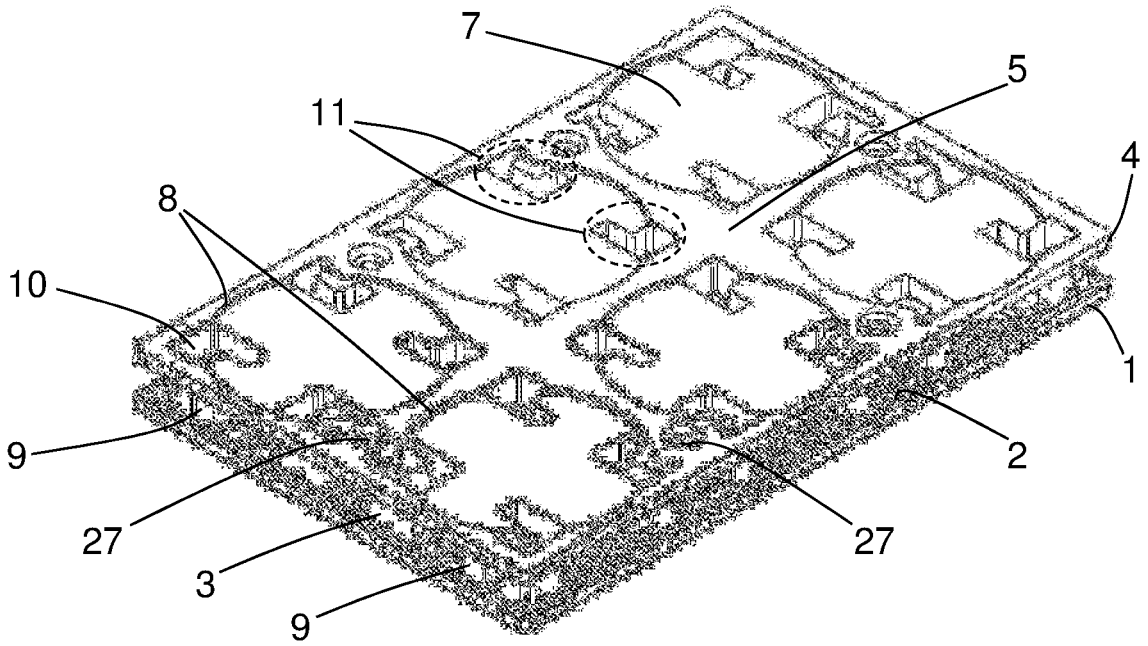

Two further embodiments of a composite pallet are shown in FIG. 3*a* and FIG. 3*b*. In the variant shown in FIG. 3*a*, the depositing areas 7 are provided with central openings 16. This reduces the quantity of material used and moreover also allows access from above or below to the end faces of the barrels, which also makes it possible among other things to store barrels which have for example fittings or projections on their end face. FIG. 3*b* shows a further example, in which the depositing areas 7 are fully closed apart from the support insert holders 10 or openings 11. This makes possible a simpler depositing of a barrel without the latter catching for example upon displacement. Located between the support insert top sides 14 and a barrel deposited in the depositing area 7 is then also a thin plastic layer, for example, with a thickness between 0.5 mm and 5 mm, which however does not impair the stability of the storage despite creep. The composite pallet or its deck and base elements can be produced, for example, in an injection-molding process or, in particular in the variant shown in FIG. 3*b*, in a compression-molding process.

Figure 6:
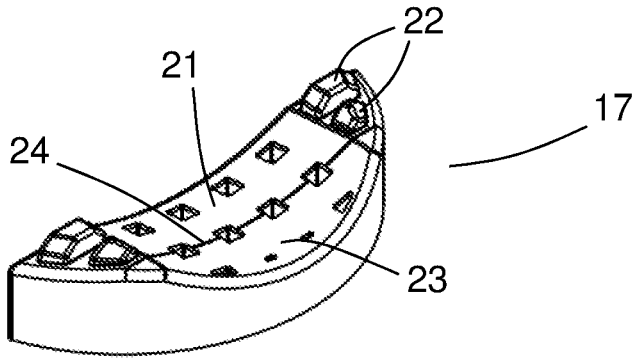
Figure 6:
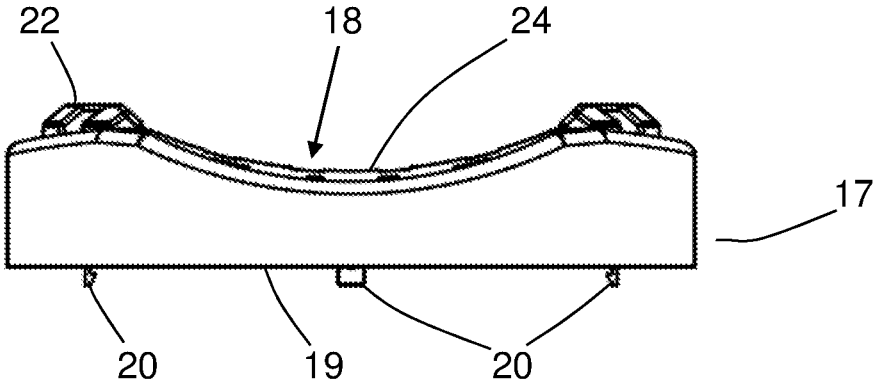
Figure 6:
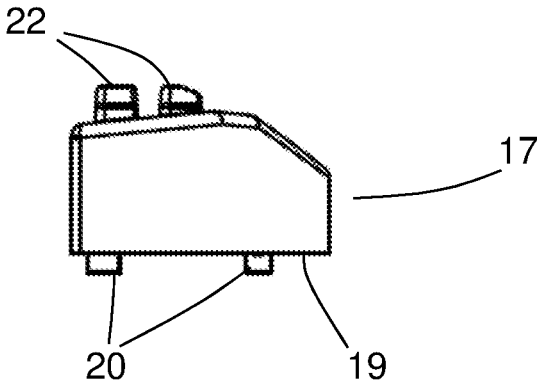
Figure 7:
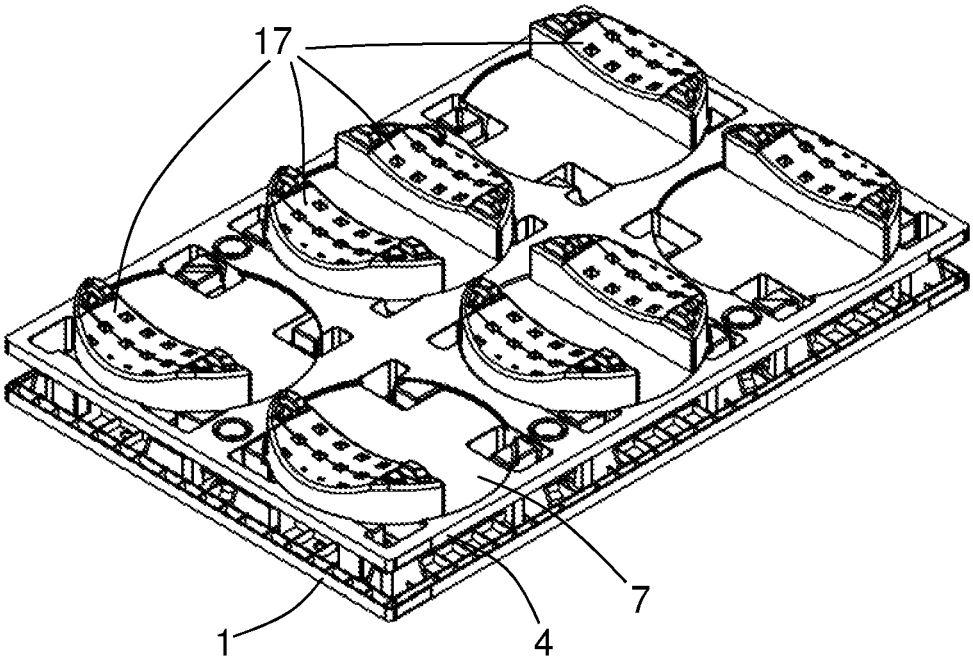

In order to facilitate the storage of horizontal barrels, a composite pallet can also comprise several bearing elements 17. These bearing elements 17 are represented in different views in FIGS. 6*a*)-*c*) and inserted into depositing areas 7 of the composite pallet in FIG. 7. The bearing elements 17 each have a bearing element top side 18 and a bearing element under side 19. In addition, means for the friction- and/or positive-locking connection of each bearing element 17 to the deck element 4 on its deck element top side 5 are provided on the bearing element under side 19 in the depositing areas 7 at positions provided for this, in the example shown in FIG. 6 these means are formed as snap locks 20. Simple plug-in connections in the form of a plug and socket connection are also suitable means for connection. Ultimately it is also sufficient to simply place the bearing elements 17 into the depositing areas 7 if the latter are formed as indentations, as they are prevented from slipping by the weight of the barrels lying thereon. The bearing element top side 18 of each bearing element 17 is provided with a first concavely cambered surface 21 with a first concave curve for storing a horizontal barrel. The first concave curve runs in the plane of the page in the view according to FIG. 6*b*). For further securing against the rolling away of a barrel, blocking elements 22 are arranged on the rims of the concavely curved surface 21 in the direction of the first concave curve.

In the simplest case, the first concavely cambered surface 21 corresponds to the section of the inner surface of a cylinder segment the axis of rotation of which—when the bearing element 17 is inserted—lies parallel to the deck element surface 5. For drums or barrels without a bulge this is sufficient. However, as a rule wooden barrels are shaped with a bulge, with the result that the first concavely cambered surface 21 should be arranged inclined or tilted at least relative to the deck element top side 5, the axis of rotation of the notional cylinder then encloses a non-zero angle with the plane which is defined by the deck element top side 5. In addition, the first concavely cambered surface 21 of each bearing element 17 can also have a second concave curve, which runs perpendicular to the first concave curve. In this way the curve of a barrel with a bulge is emulated, which leads to a more stable storage of such barrels. In the view shown in FIG. 6*b*) of a bearing element 17, the second concave curve runs in the direction perpendicular to the plane of the page. In an exemplary configuration, two bearing elements 17 can then be inserted, for example, mirror-symmetrical into two adjacent depositing areas 7, wherein the two second concave curves of the two bearing elements 17 then form a combined concave curve which corresponds to or at least approximates the camber of the barrel to be stored thereon.

However, the available space, in particular in the case of smaller barrels, still cannot be optimally utilized in this way. In a further design, the bearing element top side 18 of each bearing element 17 is therefore provided with a second concavely cambered surface 23 which has a combined curved edge 24 with the first concavely cambered surface 21, wherein the normal vectors on both sides of the curved edges 24 perpendicular thereto enclose a non-zero angle. This can be seen particularly well in FIG. 6*a*). The second concavely curved surface 23 can be designed like the first concavely curved surface 21 and can likewise have two curves running perpendicular to each other. In particular, the second concavely cambered surface can also be arranged analogously to the first concavely cambered surface 21, with the result that in the case of a serial arrangement of two bearing elements in two depositing areas 7 one behind the other, but not mirror-symmetrical, the first concave curve of one bearing element 17 forms a combined concave camber with the second concave curve of the other bearing element 17 arranged behind it. This allows great flexibility in the use of the bearing elements 17 with simultaneously very stable storage of barrels.

Bearing support element holders for holding further support inserts, the shape of which is adapted to the bearing elements 17, are formed on the under side of each bearing element 17—not shown here. These bearing support element holders are preferably located underneath the corner areas of the bearing elements 17, i.e. underneath the areas where the blocking elements 22 are arranged. In this configuration, when bearing elements 17 are used, the bearing support element holders are arranged above support element holders 10 of the deck element top side 5. The further support inserts then have support insert under sides which rest against support insert top sides 14 of the support inserts 9 inserted into the deck element 4. In this way, the load caused by the weight of the barrels is transmitted downwards directly via the support inserts.

The further support inserts are likewise manufactured from a material which has a higher creep modulus than plastic over the predefined period which decreases less than that of plastic over this period. As with the support inserts 9, the creep modulus should preferably remain substantially constant over the predefined period after an initial adjustment to the loading.

Moreover, it is also possible to provide openings at the points of the bearing elements 17 on which the blocking elements 22 sit, and to shape the further support inserts correspondingly such that the blocking elements 22 are formed on their top sides. Like the support inserts 9, the further support inserts can likewise be manufactured, for example, from concrete, wood, stainless steel or stone.

Figure 8:
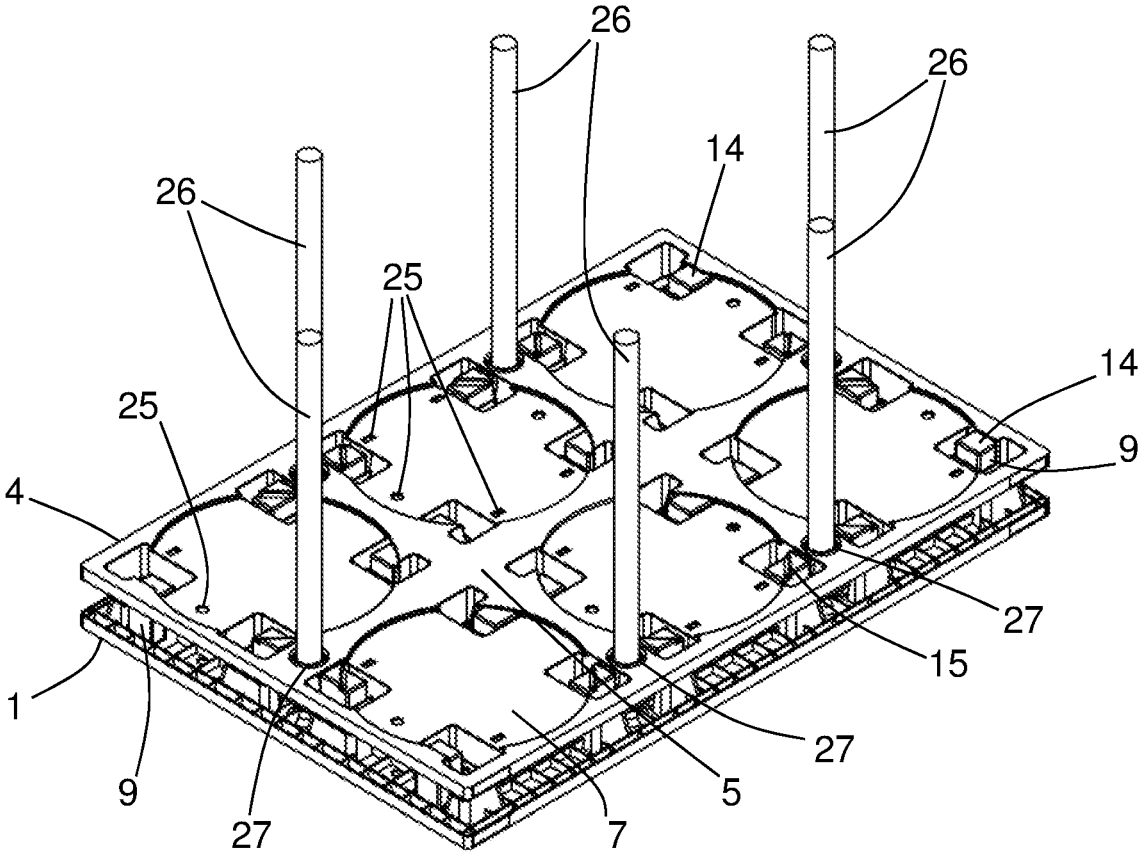

A further design of a composite pallet is shown in FIG. 8. There, firstly, there are shown in the depositing areas 7 snap lock openings 25, into which the snap locks 20 of the bearing elements 17 can be inserted. In addition, the arrangement comprises several—here six—supporting rods 26 for connection to a further composite pallet and for support against same. For this, the deck element 4 and the base element 1 have several through-openings 27 for clasping the circumference of the supporting rods 26 inserted into the through-openings 27 by positive locking. The supporting rods 26 are likewise made of a material with a higher creep modulus than that of plastic, preferably metal, in particular stainless steel, or else wood due to the better bending properties or lower brittleness compared with concrete or stone. The material must not be too brittle as otherwise it could break under loading.

The supporting rods 26 can be formed solid or hollow, they can for example be formed cylindrical with a circular cross section, or also with a square, rectangular or polygonal cross section, wherein the through-openings 27 are adapted to the shape of the cross section. Each supporting rod 26 has two ends. One end of an inserted rod 26 can be in direct contact with one support insert 9. As a result, the loading of the deck element 4 and of the base element 1 of the composite pallet with the weight of the further composite pallet is reduced, as the force is transmitted directly by the supporting rods 26 into the support inserts 9. For this, the support inserts 9 must either have a support insert top side 14 the surface of which is large enough to support a barrel for one thing and the end of the supporting rod 26 for another. Alternatively, support inserts 9 can also be provided only for the supporting rods 26.

However, the combination support inserts 12 are particularly suitable for supporting the supporting rods 26: the bars 13 each connecting two support inserts 9 can be used in order to support a supporting rod 26. As the bar 13 is made of the same material as the support inserts 9, or the combination support inserts 12 are in each case manufactured in one piece, in this sense there is likewise a direct contact—without plastic in between—between supporting rod 26 and the support inserts 9 when the supporting rod lies on the bar 13. In the design shown in FIG. 8, one end of the supporting rods 26 is in direct contact via the bars 13 with support inserts 9, i.e., there is no plastic layer between the two supporting elements.

In the case of connection to a further composite pallet above the composite pallet shown in FIG. 8, the top ends of the supporting rods 26 correspondingly rest against the under sides of the support inserts used there, with the result that the load is substantially absorbed by the plastic and in particular by the barrels when the supporting rods 26 are long enough.

Figure 9:
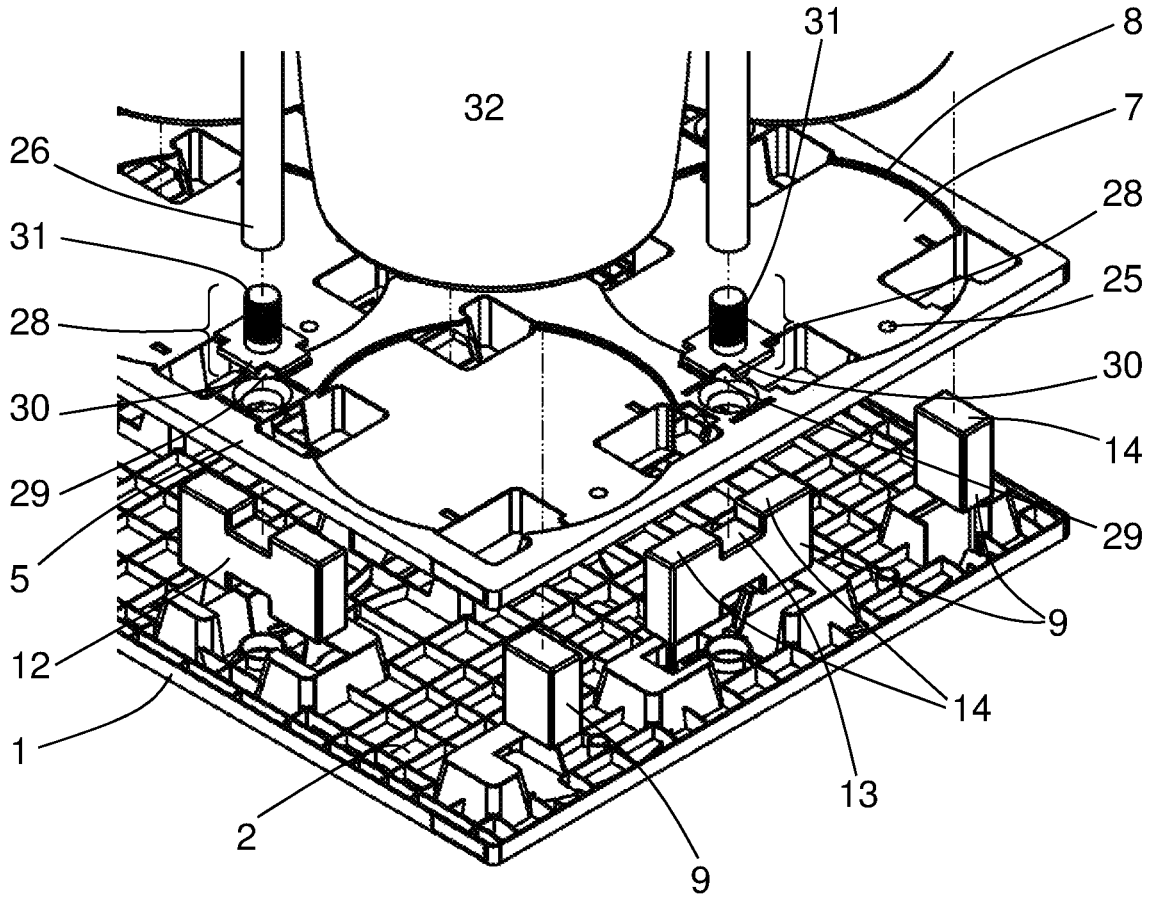

Whereas in the variant shown in FIG. 8, the supporting rods 26 are pushed through the through-openings 27 and lie with their ends directly against or on support inserts 9, it is provided in a further design to connect the ends of the supporting rods to height-adjustment elements 28, as shown in FIG. 9 in an exploded drawing of a section of a composite pallet. In this case the height-adjustment elements 28 are in direct contact with the support inserts 9 and rest against same. For a height adjustment it is sufficient if a height-adjustment element 28 is attached to one end of a rod 26, but it is also possible to arrange height-adjustment elements 28 at both ends of the supporting rods 26. For example, the height-adjustment element has on its under side a cylindrical element 29, the cross section of which is adapted to the diameter of the through-opening 27 or of the supporting rod 26. For further stabilization, but not for load transmission, a cover 30 is optionally provided, this increases the stability against lateral movements and can be connected to, for example via a snap lock, clipped to or simply just placed on the deck element top side. However, it can also be designed such that it assumes an additional supporting function in that it supports itself partially on the support insert top sides 14. This is shown in detail in FIG. 10. The cover 30 is preferably manufactured from metal.

The height-adjustment element 28, which, like the supporting rods 26, is made at least partially from metal, preferably from stainless steel, has an external screw thread 31 on its top side above the cover 30 which faces the supporting rod 26. Correspondingly, at least at one end the supporting rods 26 have an internal screw thread matching the external screw thread 31, thus can be screwed onto the external screw thread 31 and thus be adjusted to different heights. Friction, which is further increased under the loading by a composite pallet arranged above, is sufficient for fixing in the chosen position.

Figure 10:
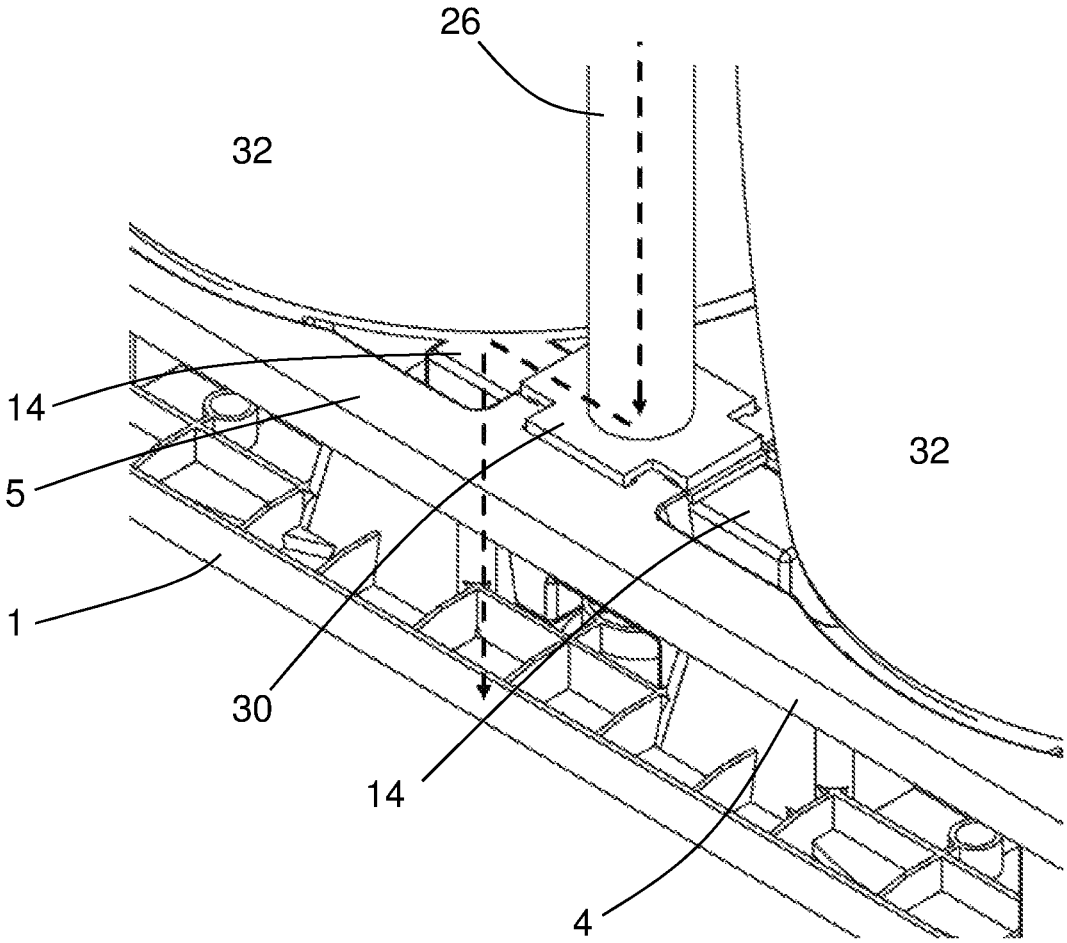

As shown in FIG. 8 and FIG. 9, the bars 13 of combination support inserts 12 lie underneath the through-openings 27, the supporting rods 26 or the height-adjustment elements 28 then rest with a cylindrical element 29 against such a bar 13. In this way, the combination support inserts 12 can be used both for supporting the barrels and for support against a composite pallet of the same type arranged above. Naturally, to support the supporting rods 26 or the height-adjustment elements 28 it is also possible to provide these with their own support inserts 9, which however may mean an additional outlay on material. The transmission of the load caused by the composite pallet stored above is shown in FIG. 10 for the area in which the supporting rods 26 or height-adjustment elements 28 are positioned on the composite pallet. The load is transmitted by the supporting rod 26 via the bar 13 of the combination support insert and from there further downwards.

Figure 11:
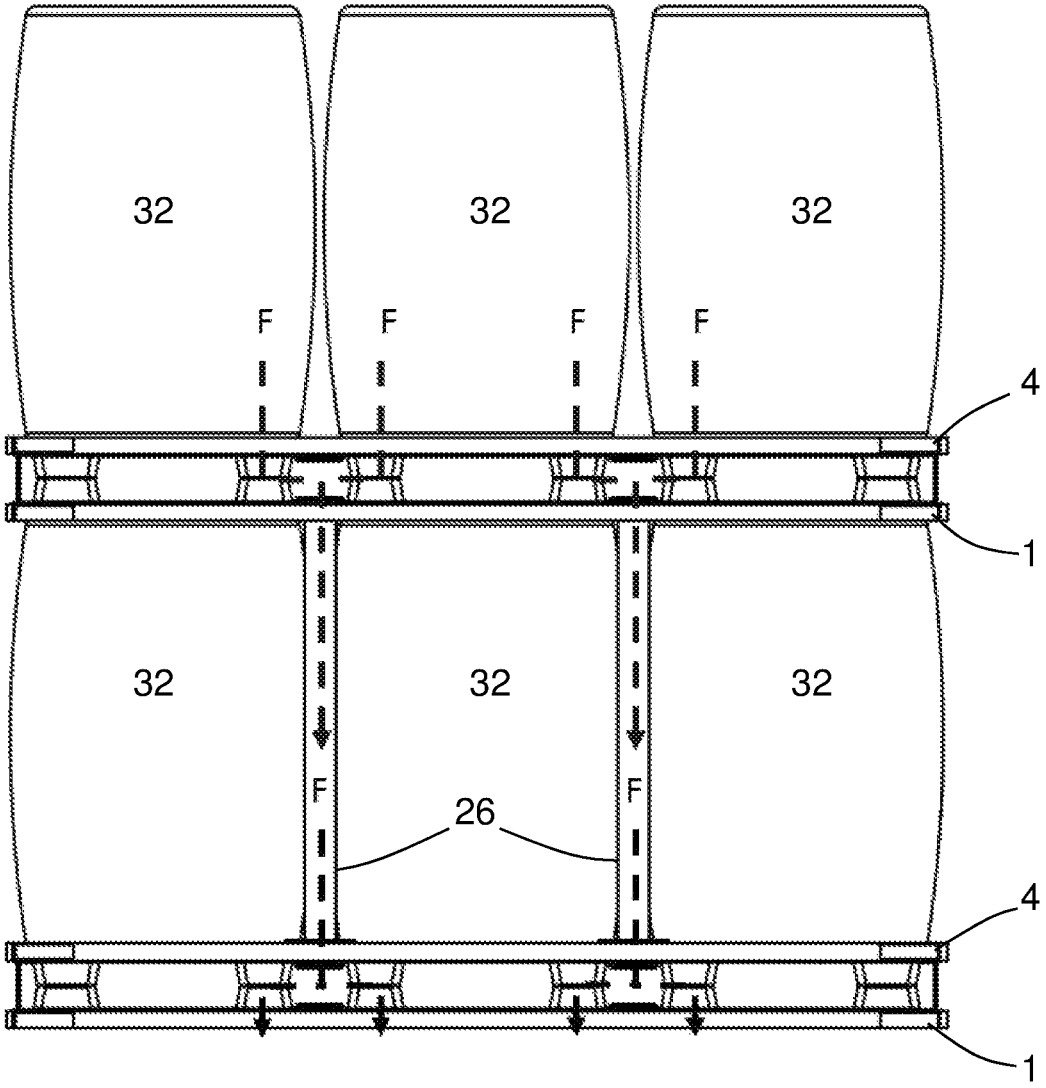

For a system of two pallets an overview of the load transmission is represented by way of example in FIG. 11. In each case six barrels 32 are stored on two composite pallets with base elements 1 and deck elements 4. The support inserts 9 inserted in the upper composite pallet and the combination support inserts 12 are loaded by the barrels above. The supporting rods 26 of the lower pallet rest with their top end or a height-adjustment element 28 against bars 13 of combination support inserts 12 of the upper composite pallet, likewise with their bottom end or a height-adjustment element 28 against bars 13 of combination support inserts 12 in the lower composite pallet. The loading exerted by the barrels 32, represented by the force "F", is then largely transmitted through the combination support inserts 12 of the upper pallet via the supporting rods 26 downwards onto the combination support inserts 12 of the lower pallet, the loading of the barrels 32 arranged in the lower pallet can be reduced in this way. Only at points at which no supporting rods 26 are arranged, such as for example in the corners, are the barrels 32 standing underneath still loaded by the barrels 32 standing above, at these points the support inserts 9 of the upper composite pallet rest on the top rims of the barrels 32 standing underneath, which can be achieved easily in particular in the case of symmetrically designed composite pallets. The height adjustment, which can also be realized in another way, for example hydraulically, can also be used to balance out the loading of the barrels standing underneath in the case of different barrel heights.

Figure 12:
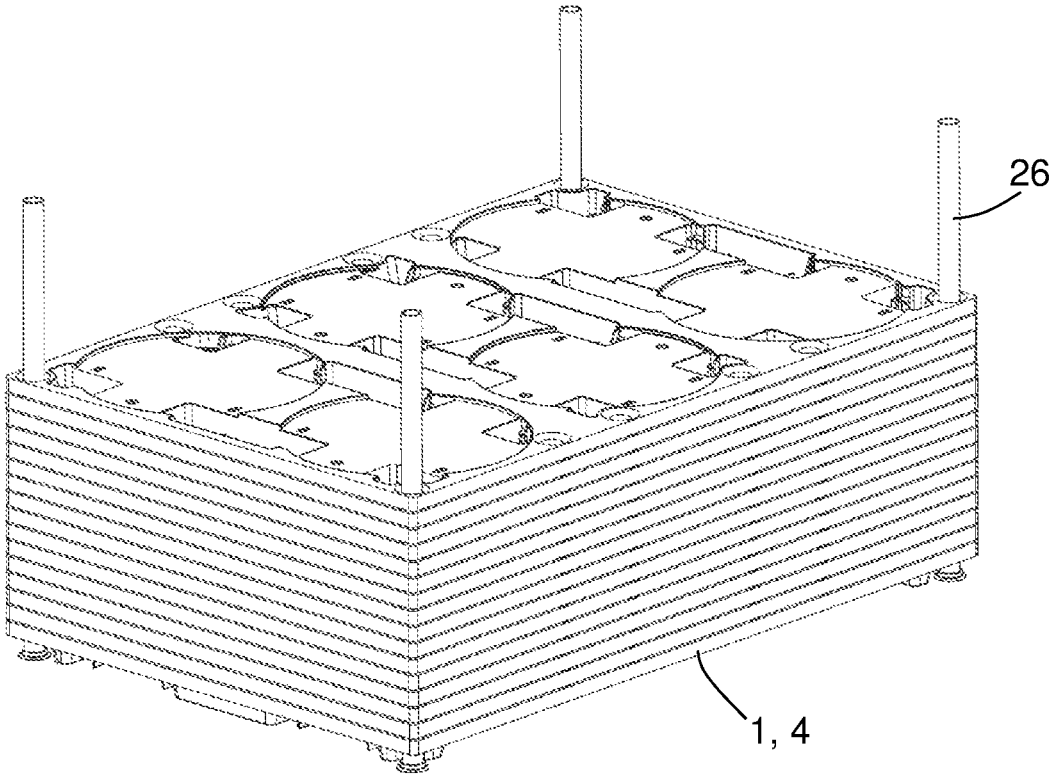

Deck element 4 and base element 1 can be manufactured in one piece as a combined element in the composite pallet, however they are preferably manufactured individually. They are particularly advantageously constructed identical, arranged mirror-symmetrical and designed such that they can easily be nested for space-saving storage, as indicated by way of example in FIG. 12. Here, the supporting rods 26 are also used for nested storage. In the embodiment shown in FIG. 12, the through-openings 27 lie directly above support insert holders 10, with the result that the ends of the supporting rods 26 rest against support insert top sides 14. Deck element 4, base element 1, the support inserts 9 including the combination support inserts 12 and optionally the supporting rods 26 with height-adjustment elements 28 can also be manufactured and delivered as a kit for ease of transport and to lower the production cost.

Figure 13:
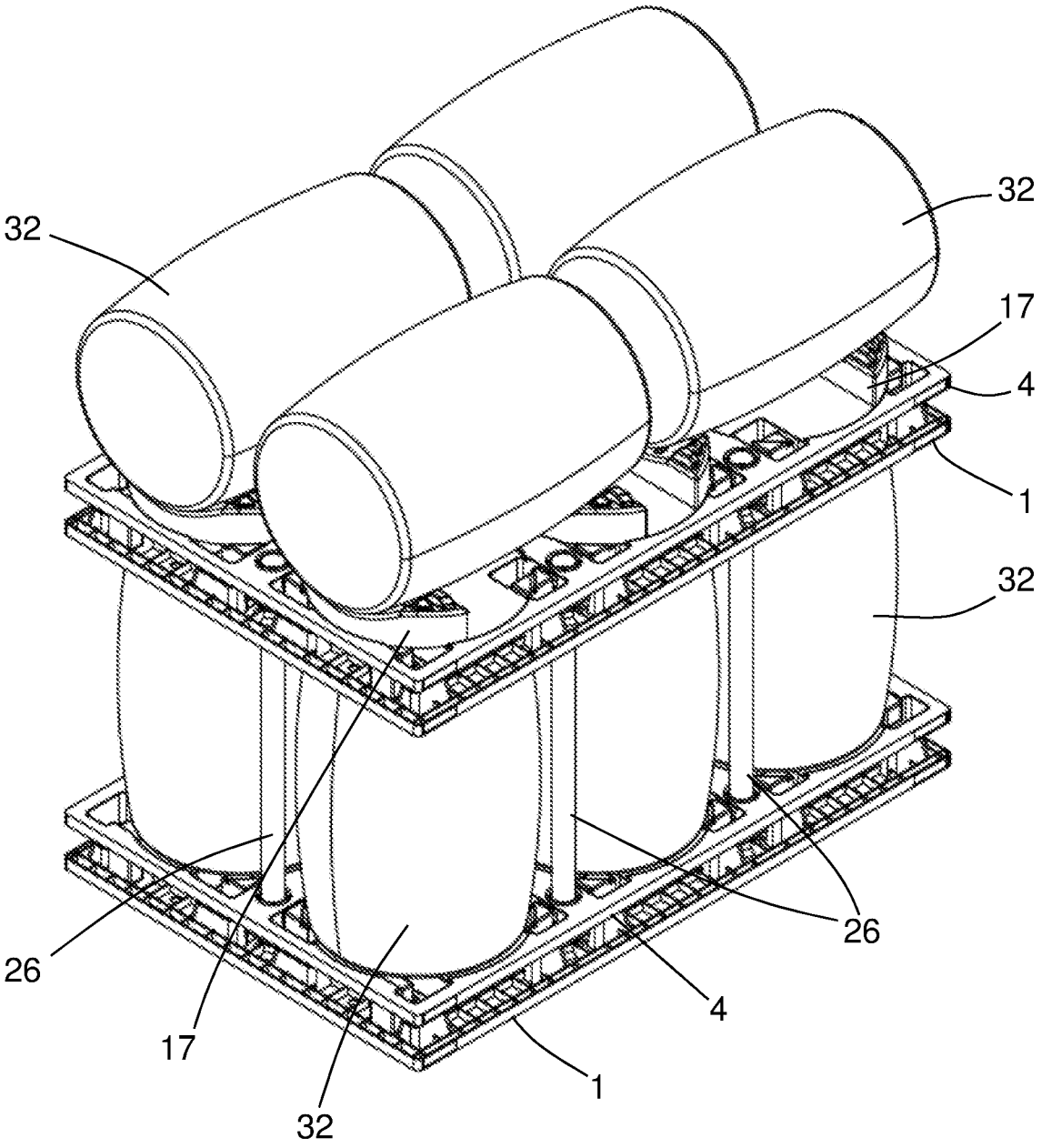
Figure 14:
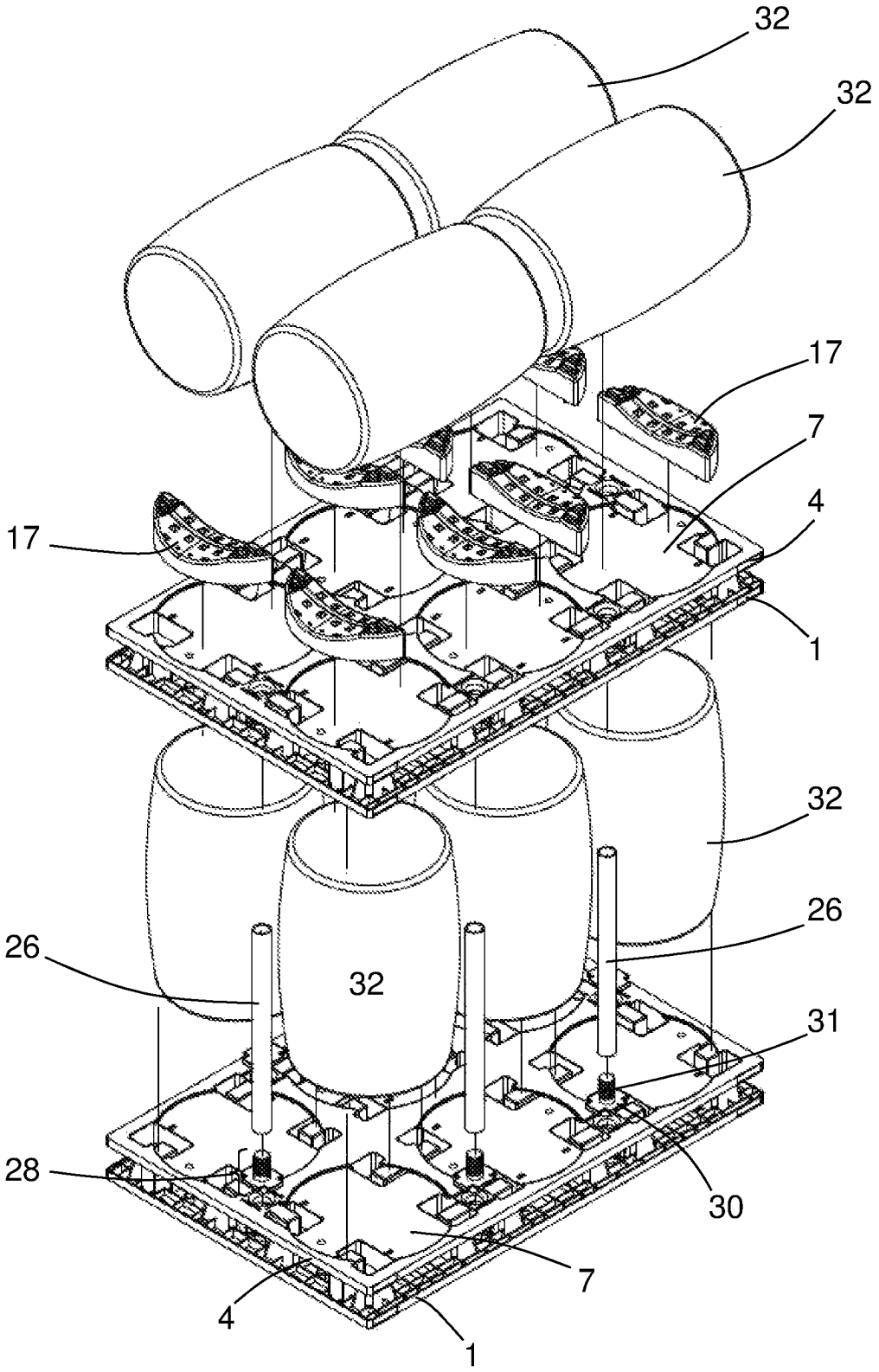

Finally, FIG. 13 shows a system of two loaded composite pallets, in which the lower pallet is loaded with vertical barrels 32 and the upper pallet is loaded with horizontal barrels 32. FIG. 14 shows an exploded drawing of the structure from FIG. 13.

The composite pallet described above can be used for the transport and long-term storage of barrels and drums, and is durable, at least over the period intended for the storage, because of the support inserts used. In addition, it offers greater flexibility than conventional wooden pallets because for one thing two pallets stacked one on top of another are better supported against each other, and barrels can be stored both vertically and horizontally.

LIST OF REFERENCE NUMBERS

1 base element
2 base element top side
3 base element support projection
4 deck element
5 deck element top side
6 deck element support projection
7 depositing area
8 rim edge
9 support insert
10 support insert holder
11 opening
12 combination support insert
13 bar
14 support insert top side
15 contour
16 opening
17 bearing element
18 bearing element top side
19 bearing element under side
20 snap lock
21 first concavely cambered surface
22 blocking element
23 second concavely cambered surface
24 curved edge
25 snap lock opening
26 supporting rod
27 through-opening
28 height-adjustment element
29 cylindrical element
30 cover
31 external screw thread
32 barrel

The invention claimed is:

1. A composite pallet for the transport and long-term storage of barrels, comprising:

a base element made of plastic with a base element top side, a base element under side and base element support projections formed projecting from the base element top side, a deck element made of plastic with a deck element top side, on which a deck for storing the barrels is formed, a deck element under side and deck element support projections formed projecting from the deck element under side, which lie on the base element support projections or are connected thereto, whereby the deck element is supported against the base element, and the deck element under side is at a distance from the base element top side, at least one depositing area for holding a vertical barrel, at least one barrel comprising a barrel base and rims at a top and a bottom of said barrel;

several first support inserts made of a material with a creep modulus which is higher over a predefined period than a creep modulus of plastic, and a decrease in which is lower than that of plastic over the predefined period, which are inserted into support element holders formed on the deck element under side and on the base element top side, and which are connected to the support element holders by friction locking or positive locking, wherein the first support inserts are arranged in support areas, which are at least partially located underneath the at least one depositing area;

wherein the first support inserts have support insert top sides on which a barrel can be stored in a depositing area of at least one depositing area, the first support inserts have support insert under sides, with which the composite pallet can be stored on a base or on rims of barrels, whereby the first support inserts are configured to absorb a load of a barrel deposited in the depositing area and ensure its long-term stable storage independently of any plastic layer located between the first support inserts and a barrel base.

2. The composite pallet according to claim 1, wherein the at least one depositing area is circular or is formed as an indentation with a rim edge for holding a vertical barrel by positive locking.

3. The composite pallet according to claim 2, wherein a first partial quantity of the first support inserts is arranged underneath the rim edge of said indentation of the at least one depositing area, with at least three first support inserts per depositing area, and a contour of the rim edge of the indentation is emulated on the support insert top sides of several first support inserts of the first partial quantity.

4. The composite pallet according to claim 1, wherein each support insert has a support insert top side, the deck element top side in a region of each support area defines a recess, and the support insert top side lies in a plane with the deck element top side or the depositing area, or, if the at least one depositing area is formed as an indentation, in a plane between the deck element top side and the at least one depositing area.

5. The composite pallet according to claim 1, wherein the support element holders for the first support inserts are incorporated into the deck element support projections and the base element support projections.

6. The composite pallet according to claim 1, further comprising a plurality of bearing elements each with a bearing element top side and a bearing element under side, and means for a friction-locking or positive-locking connection of the bearing elements on the bearing element under side to the deck element on its deck element top side, wherein the bearing element top side of each bearing element is provided with a first concavely cambered surface with a first concave curve for storing a horizontal barrel.

7. The composite pallet according to claim 6 with at least two depositing areas, wherein a first concavely cambered surface of each bearing element has a second concave curve perpendicular to the first concave curve to store a barrel with a bulge.

8. The composite pallet according to claim 6, wherein the bearing element top side of each bearing element is provided with a second concavely cambered surface which has a combined curved edge with the first concavely cambered surface.

9. The composite pallet according to claim 6, further comprising further support inserts and bearing support element holders, said bearing support element holders formed on the bearing element under side of each bearing element and configured to hold said further support inserts.

10. The composite pallet according to claim 9, wherein the bearing support element holders are arranged above support element holders of the deck element top side, and the further support inserts have support insert under sides which rest against support insert top sides of the first support inserts.

11. The composite pallet according to claim 1, wherein the first support inserts and the further support inserts are made of concrete, wood, stainless steel or stone.

12. The composite pallet according to claim 1, further comprising several supporting rods for connection to a further composite pallet and for support against same, wherein the deck element and the base element have several through-openings for clasping a circumference of the supporting rods inserted into the through-openings by positive locking, and ends of the inserted supporting rods or height-adjustment elements connected to the ends of the supporting rods are in direct contact with the first support inserts, whereby the loading of the deck element and of the base element of the composite pallet with a weight of the further composite pallet is reduced.

13. The composite pallet according to claim 12, wherein support inserts of a second partial quantity of the first support inserts are formed as one-piece combination support inserts, two first support inserts are connected to each other by a bar, and the bars of the combination of the first support inserts are positioned underneath the through-openings to hold the supporting rods, and the supporting rods or the height-adjustment elements each rest against a bar.

14. The composite pallet according to claim 12, wherein the supporting rods and the height-adjustment elements are made at least partially from metal, the height-adjustment elements have an external screw thread and at least at one end the supporting rods have an internal screw thread matching the external screw thread.

15. The composite pallet according to claim 1, wherein support inserts of a second partial quantity of the first support inserts are formed as one-piece combination support inserts, and wherein two first support inserts are connected to each other by a bar.

16. The composite pallet according to claim 1, wherein the deck element or the base element are manufactured individually and can be nested with other deck elements or base elements.

17. The composite pallet according to claim 1, wherein the deck element and the base element are constructed identical and arranged mirror-symmetrical relative to a mirror plane which lies parallel to the deck element top side and to the base element under side and is at a same distance to both.

18. The composite pallet according to claim 1, wherein the deck element is manufactured in one piece with the base element.

19. A kit for a composite pallet according to claim 1.

* * * * *